US009657429B2

(12) United States Patent
Son et al.

(10) Patent No.: US 9,657,429 B2
(45) Date of Patent: May 23, 2017

(54) LAUNDRY MACHINE

(75) Inventors: Chang Woo Son, Gyeongsangnam-do (KR); Sang Hun Bae, Gyeongsangnam-do (KR); Chul Jin Choi, Gyeongsangnam-do (KR); Dong Hyun Kim, Gyeongsangnam-do (KR); Young Bok Son, Gyeongsangnam-do (KR); Heung Jae Kim, Gyeongsangnam-do (KR)

(73) Assignee: LG ELECTRONICS INC., Seoul (KR)

( * ) Notice: Subject to any disclaimer, the term of this patent is extended or adjusted under 35 U.S.C. 154(b) by 887 days.

(21) Appl. No.: 11/980,781

(22) Filed: Oct. 31, 2007

(65) Prior Publication Data

US 2008/0141557 A1 Jun. 19, 2008

(30) Foreign Application Priority Data

Dec. 14, 2006 (KR) ..... 10-2006-0127589

(51) Int. Cl.
*D06F 58/28* (2006.01)
*D06F 58/20* (2006.01)

(52) U.S. Cl.
CPC ..... *D06F 58/20* (2013.01); *D06F 58/28* (2013.01); *D06F 2058/2854* (2013.01)

(58) Field of Classification Search
CPC ... D06F 58/20; D06F 58/28; D06F 2058/2854
USPC ..... 34/565, 380, 381, 382, 389, 404, 409, 34/411, 443, 446, 470, 494, 529, 534, 34/572, 139, 603, 192, 201; 68/5 R, 5 C, 68/12.26, 12.27, 222; 223/51
See application file for complete search history.

(56) References Cited

U.S. PATENT DOCUMENTS

| | | | | |
|---|---|---|---|---|
| 2,598,057 | A | 5/1952 | Horvath | |
| 5,461,887 | A * | 10/1995 | VonPless | 68/18 F |
| 6,718,974 | B1 * | 4/2004 | Moberg | 128/204.14 |
| 7,020,986 | B1 * | 4/2006 | Nakai et al. | 34/596 |
| 7,091,454 | B2 * | 8/2006 | Cho et al. | 219/401 |
| 2004/0103696 | A1 * | 6/2004 | Kim et al. | 68/17 R |
| 2004/0134094 | A1 * | 7/2004 | Hahn et al. | 34/595 |
| 2005/0103721 | A1 * | 5/2005 | Fritze | 210/744 |
| 2005/0132593 | A1 * | 6/2005 | Doh et al. | 34/73 |
| 2006/0011071 | A1 * | 1/2006 | Cho et al. | 99/417 |
| 2007/0151310 | A1 * | 7/2007 | Wright et al. | 68/3 R |

FOREIGN PATENT DOCUMENTS

| | | | | |
|---|---|---|---|---|
| CN | 1637197 A | | 7/2005 | |
| CN | 1776073 A | | 5/2006 | |
| DE | 195 05 607 | | 6/1996 | |
| DE | 19505607 | * | 6/1996 | D06F 58/24 |
| DE | 102 60 151 | | 7/2004 | |
| EP | 1 550 760 | | 7/2005 | |

(Continued)

OTHER PUBLICATIONS

English Translation of Kawai et al., JP 02116399A, May 1990.*

*Primary Examiner* — Jiping Lu
(74) *Attorney, Agent, or Firm* — Dentons US LLP

(57) ABSTRACT

The present invention relates to a laundry dryer that can prevent as well as remove wrinkles of laundry. A laundry dryer has a water supply source configured to be detachable from the laundry machine and a switch to switch a steam generator or a pump off or on when the water supply source is detached or not.

16 Claims, 10 Drawing Sheets

(56) References Cited

FOREIGN PATENT DOCUMENTS

| | | | | | |
|---|---|---|---|---|---|
| EP | 1 555 340 | | | 7/2005 | |
| JP | 63-009292 | | | 7/1985 | |
| JP | 2-116399 | A | * | 5/1990 | ..... D06F 58/04 |
| JP | 2004-321316 | | | 11/2004 | |
| JP | 2006-141986 | | | 6/2006 | |
| JP | 2006-212561 | | | 8/2006 | |
| KR | 10-2006-0102952 | A | | 9/2006 | |
| KR | 10-2006-0103002 | A | | 9/2006 | |
| KR | 10-0640788 | B1 | | 10/2006 | |
| KR | 2008-0012006 | | | 2/2008 | |
| WO | WO 2006/101336 | | | 9/2006 | |

* cited by examiner

LAUNDRY MACHINE

CROSS REFERENCE TO RELATED APPLICATION

This application claims the benefit of the Korean Patent Application No. 10-2006-0127589, filed on Dec. 14, 2006, which is hereby incorporated by reference in its entirety as if fully set forth herein.

BACKGROUND OF THE DISCLOSURE

Field of the Disclosure

The present invention relates to a laundry machine. More particularly, the present invention relates to a laundry dryer that can prevent as well as remove wrinkles of laundry.

Discussion of the Related Art

Laundry dryers are typically electric appliances that dry washed laundry, mainly washed clothes, by using high temperature air. In general, the laundry dryer is configured of a drum, a driving motor, heating means and a blower unit. Laundry is held in the drum and the driving motor drives the drum. The heating means heats air drawn in the drum. The blower unit sucks or discharges the air inside the drum.

Laundry dryers may be categorized, based on a method of heating the air, for example, heating means, into electric-type laundry dryers and gas-type laundry dryers. In case of the electric-type laundry dryer, air is heated by using electric resistance heat. Meanwhile, in case of the gas-type laundry dryer, air is heated by using heat generated from gas combustion.

On the other hand, laundry dryers may be categorized into condensation-type laundry dryers and exhaustion-type laundry dryers. In case of the condensation-type laundry dryer, air is heat-exchanged with laundry in the drum and the damp air is circulated, not discharged outside, to be heat-exchanged with external air at an auxiliary condenser. At this time, water is condensed and discharged outside. In case of the exhaustion-type laundry dryer, air is heat-exchanged with laundry in the drum and the damp air is directly discharged outside the laundry dryer.

Based on a method of loading laundry, laundry dryers may be categorized into top loading-type laundry dryers and front loading-type laundry dryers. In case of the top loading-type laundry dryer, laundry is loaded into the drum through a top of the laundry dryer. In case of the front loading-type laundry dryer, laundry is loaded into the drum through a front of the laundry dryer.

However, above conventional laundry dryers may have following problems.

Commonly, after performing washing and spinning, the laundry is loaded and dried in the conventional laundry dryers. In a view of a principle of water washing, washed laundry has wrinkles and the wrinkles created during the washing and spinning are not removed during the drying. As a result, auxiliary ironing is necessary in the conventional laundry dryer to remove the wrinkles, which causes a problem.

Moreover, in case that clothes rather than the washed laundry are kept and used, the clothes like the washed laundry may have wrinkles, crumples and fold marks (hereinafter, referred to as 'wrinkles'). Accordingly, there have been demands for development of devices capable of removing wrinkles easily even after common usage and keeping.

SUMMARY OF THE DISCLOSURE

Accordingly, the present invention is directed to a laundry dryer.

An object of the present invention is to provide a laundry dryer provided with a steam generator that can prevent and/or remove wrinkles of laundry.

Another object of the present invention is to provide a laundry dryer provided with a detachable water supply source that supplies water to the steam generator.

The other object of the present invention is to provide a laundry dryer to ensure safety of product.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry dryer comprises a detachable water supply source; and switching unit for switching power of a steam generator or a pump based on whether the water supply source is detached or not.

The laundry dryer realizes the removal and/or prevention of wrinkles from the laundry effectively, and also improves the safety since the driving of steam generator is determined based on whether the water supply source is detached or not.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

To explain a laundry dryer according to the present invention and a control method thereof, top loading-type, electric-type and condensation-type laundry dryers will be presented as examples on convenience sake. However, the present invention is not limited to the above examples, and it can be applicable to front loading-type, gas-type and condensation-type laundry dryers.

Figure 1:
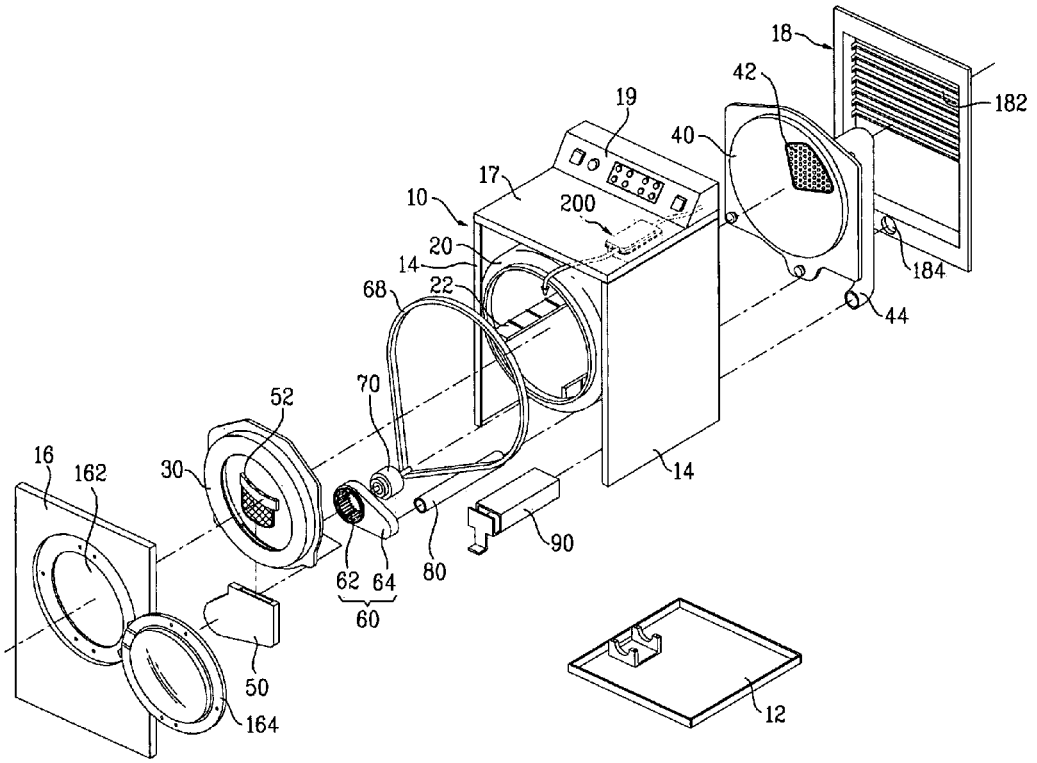
FIG. 1 is an exploded perspective view illustrating an embodiment of a laundry dryer according to the present invention.
Figure 2:
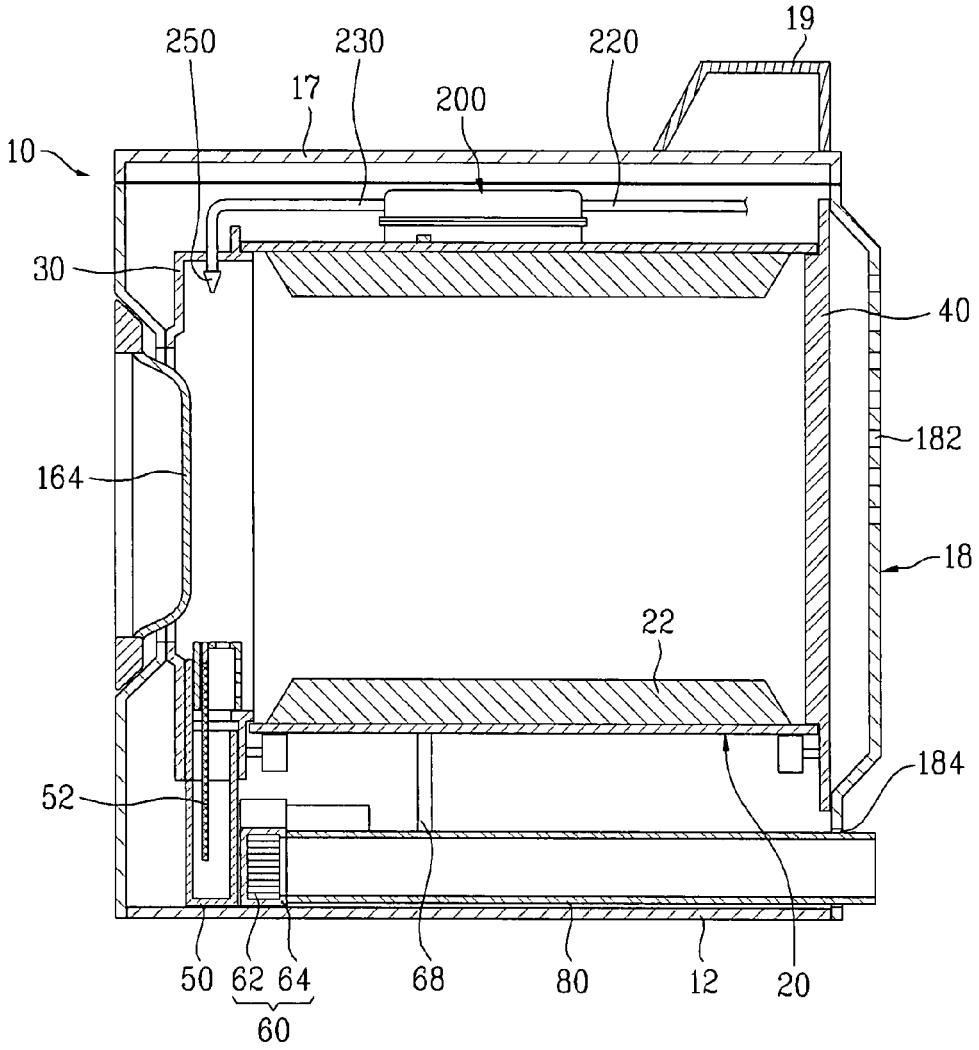
FIG. 2 is a longitudinal section view of FIG. 1.

With reference to FIGS. 1 and 2, a first embodiment of a laundry dryer according to the present invention and a control method thereof will be explained as follows.

A cabinet 10 defines an exterior appearance of the laundry dryer, and a drum 20 is rotatable in the cabinet 10. Also, a motor 70 and a belt 68 for driving the drum 20 are provided in the cabinet 10. A heater (hereinafter, referred to as "hot air heater") 90 is provided in a predetermined portion of the cabinet 10 to heat air and to generate high temperature air (hereinafter, referred to as "hot air"). A hot air supply duct 44 is provided in a predetermined portion of the cabinet 10 to supply the hot air generated in the hot air heater 90 to the drum 20.

Also, there are provided an exhaustion duct 80 and a blower unit 60 in the laundry dryer according to the present invention. The damp air heat-exchanged with the laundry in the drum 20 is discharged outside the drum 20 through the exhaustion duct 80. Also, the blower unit 60 sucks the damp air. Further, a steam generator 200 is provided in a predetermined portion of the cabinet 10 to generate high temperature steam.

This embodiment presents on convenience sake an indirect drive type in that the drum 20 is rotated by the motor 70 and the belt 68, but the present invention is not limited thereto. That is, it is possible to apply the present invention to a direct drive type in that the drum 20 is directly rotated by connecting the motor 70 to a rear surface of the drum 20.

Each configuration will be explained in detail.

The cabinet 10 defines an exterior appearance of the laundry dryer, wherein the cabinet 10 includes a base 12, a pair of side covers 14, a front cover 16, a rear cover 18 and a top cover 17. The base 12 forms a bottom surface of the laundry dryer, and the side covers 14 are provided in perpendicular to the base 12. The front cover 16 and the rear cover 18 are installed in a front portion and a rear portion of the side covers 14, respectively. The tope cover 17 is installed in an upper portion of the side covers 14.

In addition, a control panel 19 having various operational switches is positioned at the top cover 17 or the front cover 16, and a door 164 is coupled to the front cover 16. An air inlet 182 and an air outlet 184 are provided at the rear cover 18. At this time, external air is drawn through the air inlet 182 and the air inside the drum 20 is discharged outside through the air outlet 184 corresponding to a final path to the outside.

An inner space of the drum 20 is employed as a drying chamber for drying the laundry. It is preferable that a lifter 22 be installed in the drum 20 to lift and drop the laundry such that the laundry is turned over to enhance drying efficiency.

In the meantime, a front supporter 30 is provided between the drum 20 and the cabinet 10, in more detail, between the drum 20 and the front cover 16. Also, a rear supporter 40 is provided between the drum 20 and the cabinet 10, in more detail, between the drum 20 and the rear cover 18.

The drum 20 is rotatably provided between the front supporter 30 and the rear supporter 40, and sealing members (not shown) for preventing water leakage are coupled between the front supporter 30 and the drum 20 and between the rear supporter 40 and the drum 20, respectively. That is, the front supporter 30 and the rear supporter 40 respectively close front and rear surfaces of the drum 20, to thereby support front and rear ends of the drum 20 as well as to form the drying chamber.

An opening is formed at the front supporter 30 to communicate the drum 20 with the outside of the laundry dryer, wherein the opening is selectively opened and closed by the door 164. In addition, a lint duct 50 as a path through which the air in the drum 20 flows outside is connected to the front supporter 30, and a lint filter 52 is installed at the lint duct 50. One side of the blower unit 60 is connected to the lint duct 50, and the other side of the blower unit 60 is connected to the exhaustion duct 80. Also, the exhaustion duct 80 is in communication with the air outlet 184 provided in the rear cover 18. As a result, once the blower unit 60 is operated, the air inside the drum 20 is discharged to the outside through the lint duct 50, the exhaustion duct 80 and the air outlet 184 in order. At this time, foreign substances including lint are filtered by the lint filter 52. Commonly, the blower unit 60 is configured of a blower 62 and a blower housing 64. The blower 64 is commonly connected to the motor 70 to drive the drum 20.

An opening 42 comprised of a plurality of through-holes is formed at the rear supporter 40, and the hot air supply duct 44 is connected to the opening 42. The hot air supply duct 44 is in communication with the drum 20, wherein the hot air supply duct 44 is employed as a path for supplying hot air to the drum 20. For that, the hot air heater 90 is installed in a predetermined portion of the hot air supply duct 44.

Figure 3:
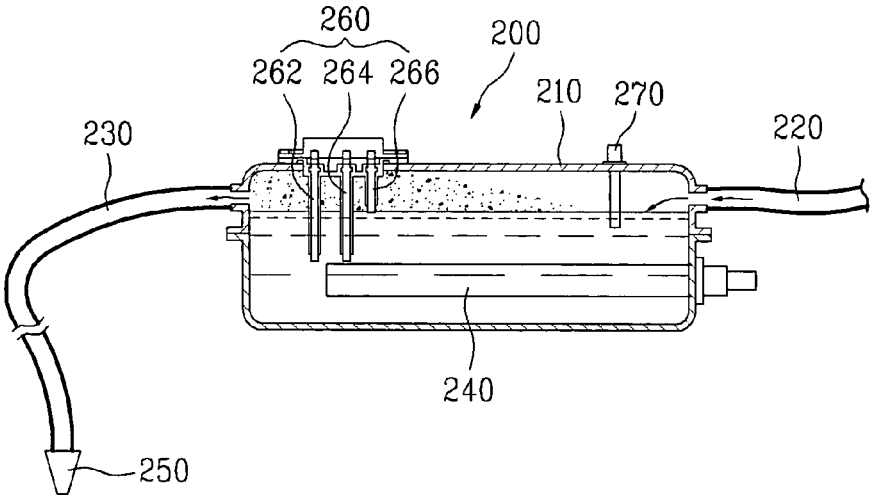
FIG. 3 is a cross section view illustrating a steam generator shown in FIG. 1.

On the other hand, the steam generator 200 is provided in a predetermined portion of the cabinet 10 to generate steam and to supply the generated steam to the inside of drum 20. Referring to FIG. 3, the steam generator 200 will be explained in detail as follows.

The steam generator 200 is configured of a water tank 210, a heater 240, a water level sensor 260 and a temperature sensor 270. In this case, water is held in the water tank 210, and the heater 240 is mounted on the inside of water tank 210. The water level sensor 260 senses water levels in the steam generator 200, and the temperature sensor 270 senses temperatures in the steam generator 200. The water level sensor 260 is configured of a common electrode 262, a low water level electrode 264 and a high water level electrode 266. A high water level is sensed based on whether an electric current is applied between the common electrode 262 and the high water level electrode 266, and a low water level is sensed based on whether an electrode current is applied between the common electrode 262 and the low water level electrode 264.

A water supply hose 220 for supplying water is connected to one side of the steam generator 200, and a steam hose 230 for discharging steam is connected to the other side of the steam generator 200. Preferably, a nozzle 250 having a predetermined shape is provided at a front end of the steam hose 230.

Typically, one end of the water supply hose 220 is connected to an external water supply source such as a water tap. The front end of steam hose 230 or the nozzle 25, that is, a steam outlet is positioned at a predetermined portion in the drum 20 to spray steam into the inside of drum 20.

In the meantime, this embodiment presents a kind of the steam generator 200 in that the heater 240 heats the water stored in the water tank 210 to generate steam (referred to as "tank heating type steam generator" on convenience sake)

and the present invention is not limited thereto. That is, any devices capable of generating steam may be applicable to the present invention. For example, a kind of steam generator in that a heater is directly installed around a water supply hose to heat the water in the water supply hose, without storing water in a predetermined space, (referred to as "pipe heating type steam generator" on convenience sake) may be applicable to the present invention.

Figure 4:
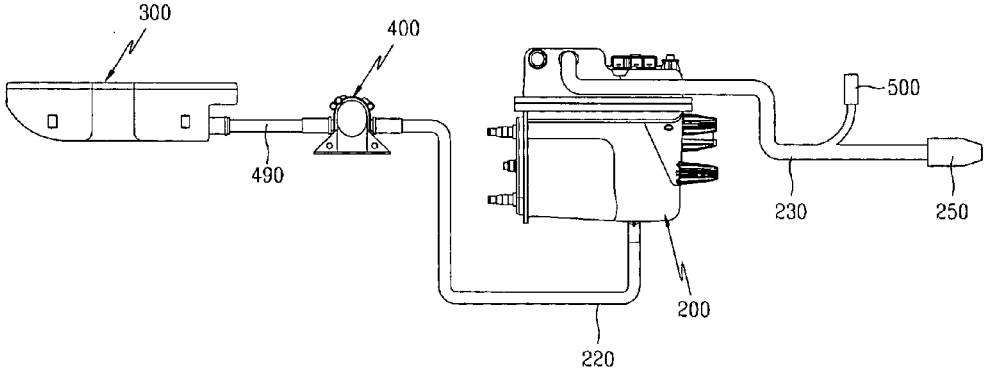
FIG. 4 is a schematic view illustrating another embodiment of a laundry dryer according to the present invention, with the focus on a steam generator.
Figure 5:
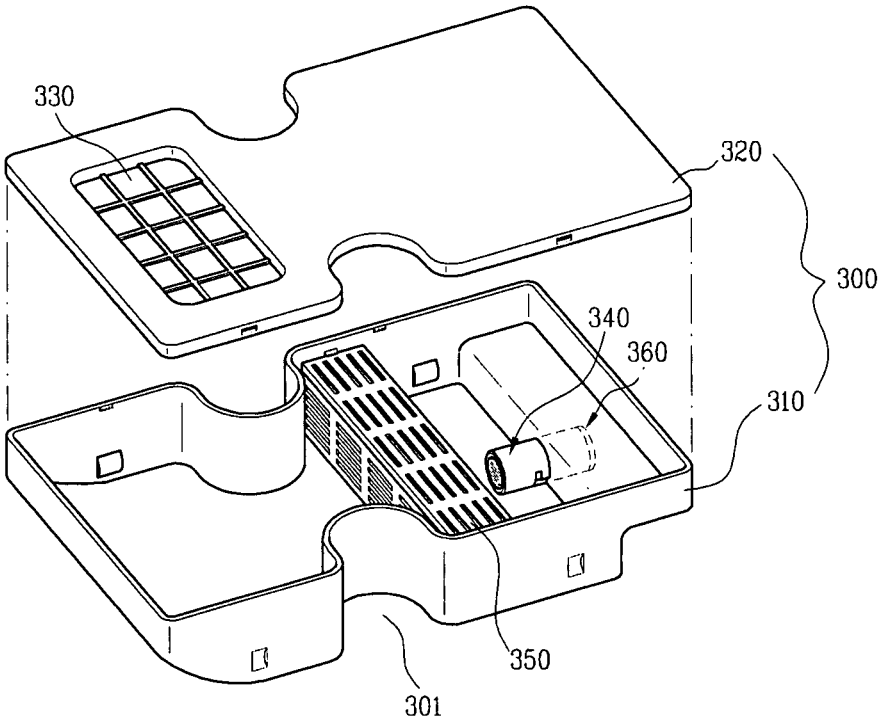
FIG. 5 is an exploded perspective view illustrating an embodiment of a water supply source shown in FIG. 4.

Referring to FIG. 4, a second embodiment of a laundry dryer according to the present invention will be explained as follows.

The second embodiment of the present invention is provided with a detachable water supply source for supplying water to the steam generator 200. If the water supply source may be a water tap described in the first embodiment, the installation of such structure will be complicated. Since water is not used in the laundry dryer, using the water tap as the water supply source necessarily requires supplementary parts for the water tap.

As a result, the second embodiment of the present invention uses the detachable water supply source 300. After the water supply source 300 is detached from the laundry dryer, the water supply source 300 is filled with water. Then, the water supply source 300 filled with water is connected to a water supply hose 220 corresponding to a water supply path for a steam generator 200, which is convenient for a user.

It is preferable that a pump 400 be installed between the water supply source 300 and the steam generator 200. The pump 400 may be rotated in a clockwise/counter-clockwise direction to supply water to the steam generator 200 or to gather remaining water of the steam generator 200 at need.

Instead of using the pump 400, it is possible to use water level difference between the water supply source 300 and the steam generator 200, so as to supply water to the steam generator 200. However, various elements included in the laundry dryer are standardized goods, and are provided with a compact design, whereby a structural space is absolutely insufficient. Accordingly, unless the various elements included in the related art laundry dryer are changed in size, water supply using the water level difference is virtually impossible.

If using the small-sized pump 400, the steam generator 200 can be installed without changing the various elements of the related art laundry dryer in size, which is useful. However, if the steam generator 200 is not used for a relatively long period of time, a heater may be damaged by the remaining water in the steam generator 200, or polluted water may be used.

In the first embodiment of the present invention, water supply and steam discharge are performed at the upper portion of steam generator 200. However, in case of the second embodiment of the present invention, the water is supplied to the lower portion of steam generator 200, and the steam is discharged from the upper portion of steam generator 200, preferably. This structure of the second embodiment is useful to gather the remaining water in the steam generator 200. Also, a valve 500 is provided in a steam hose 230, that is, a path for discharging the steam to the outside from the steam generator 200.

In the second embodiment of the present invention, the detachable water supply source 300 (hereinafter, referred to as "cartridge" on convenience sake) includes a lower housing 310 which substantially stores the water therein, and an upper housing 320 which is detachably provided in the lower housing 310. As the cartridge 300 is provided with the lower and upper housings 310 and 320, it is easy to clean scale or deposit from the inside of cartridge 300, and also to clean and recycle filters 330 and 340 and water-softening member 350 by separation.

Figure 6:
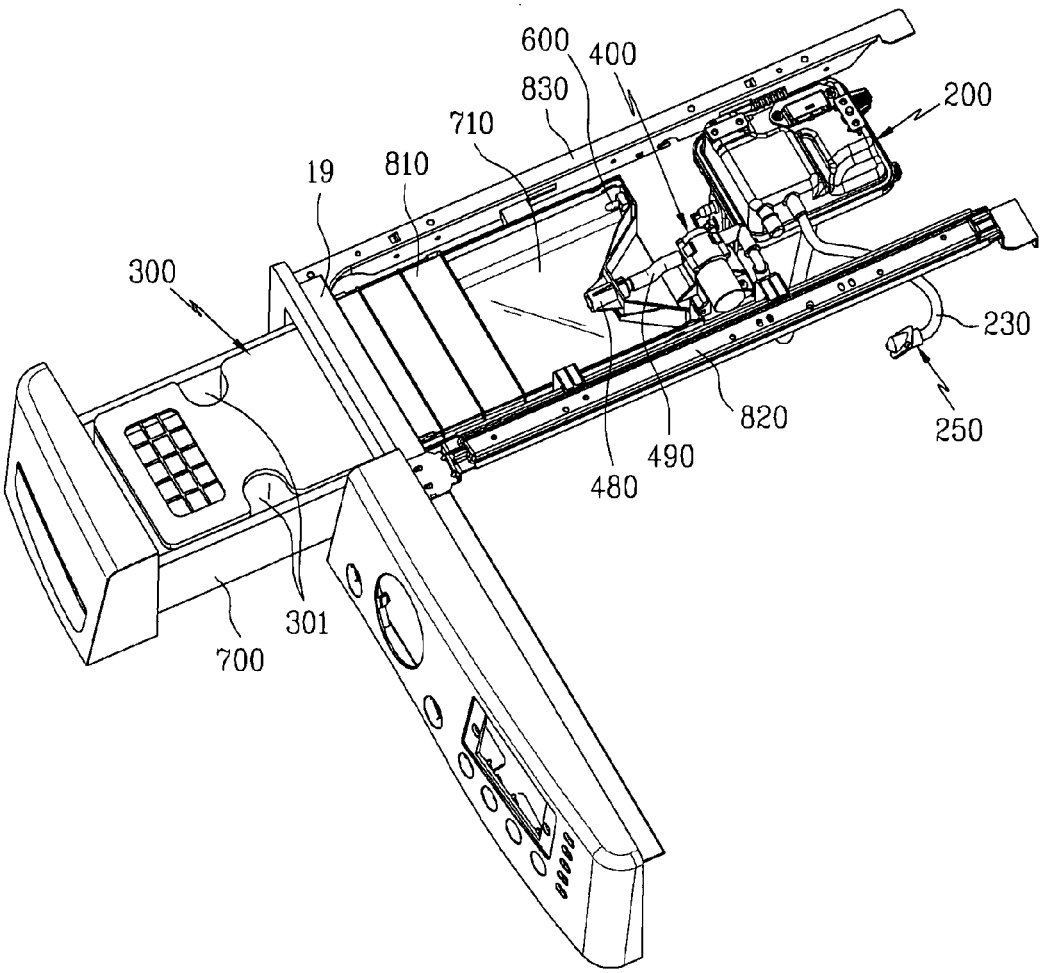
FIG. 6 is a perspective view illustrating structural elements shown in FIG. 4.

Referring to FIG. 6, a preferred embodiment in arrangement of elements for a steam line with focus on the steam generator according to the present invention will be explained as follows.

Preferably, a drawer-type container (hereinafter, referred to as "drawer") 700, which can be pulled out and pushed in, is installed at a predetermined portion of the laundry dryer. Preferably, the cartridge 300 is mounted on the drawer 700. That is, the drawer 700 having the cartridge 300 mounted thereon is pulled out and pushed in, rather than to directly connect the cartridge 300 to a connection part 480. Thus, the cartridge 300 is indirectly connected to the connection part 480 or is indirectly separated from the connection part 480, preferably.

The drawer 700 is provided in the front of laundry dryer, for example, a control panel 19, preferably. In more detail, a supporter 820 is provided at the rear of control panel 19. That is, the supporter 820 is nearly parallel to a top frame 830. Preferably, a drawer guide 710 for guiding and supporting the drawer 700 is provided at the support 820 and the top frame 830. It is preferable that a top guide 810 be installed at a predetermined portion of an upper side of the drawer guide 710.

The upper side and one lateral side (the front direction of laundry dryer) of the drawer guide 710 are opened. Through the opened lateral side of drawer guide 710, the drawer 700 is pulled out and pushed in. Preferably, the connection part 480 is provided at the other side of the upper surface of the drawer guide 710.

As explained above, it is preferable that the drawer 700 be installed at the front of laundry dryer, for the convenience of user. FIG. 6 illustrates the laundry dryer where the control panel 19 is provided at a front cover, whereby the drawer 700 is pulled out or pushed in the control panel 19, however the present invention is not limited thereto. For example, as shown in FIG. 1, if the control panel is installed at the top cover, the drawer 700 may be directly installed at the front cover.

If mounting the cartridge 300 on the drawer 700, at least both sides of cartridge 300 correspond to both sides of drawer 700 in shape, for the tight connection between the both sides of cartridge 300 and the both sides of the drawer 700. For the detachment and connection of cartridge 300, there are recess parts 301 at the both sides of cartridge 300. Preferably, the recess parts 301 are used for the detachment and connection of cartridge 300.

A method of supplying water to the cartridge 300 will be explained as follows.

Once the user pulls out the drawer 700, the cartridge 300 is also pulled out. In this state, the cartridge 300 is detached from the drawer 700, and then the detached cartridge 300 is filled with water. After the completion of filling water, the cartridge 300 filled with water is mounted on the drawer 700, and the drawer 700 is pushed in, so that the cartridge 300 is automatically connected to the connection part 480. Thus, water filled in the cartridge 300 is opened toward the direction of pump 400.

Especially, there is additional switching unit which can sense whether the cartridge is connected to or detached from the laundry dryer. This switching unit may be formed of a switch to generate signals in case of mounting of the cartridge 300, or a controller to switch power source of the steam generator 200 or the pump 400 in case of mounting of the cartridge 300.

Hereinafter, a structure of the switching unit formed of a limit switch will be explained as follows.

Figure 7:
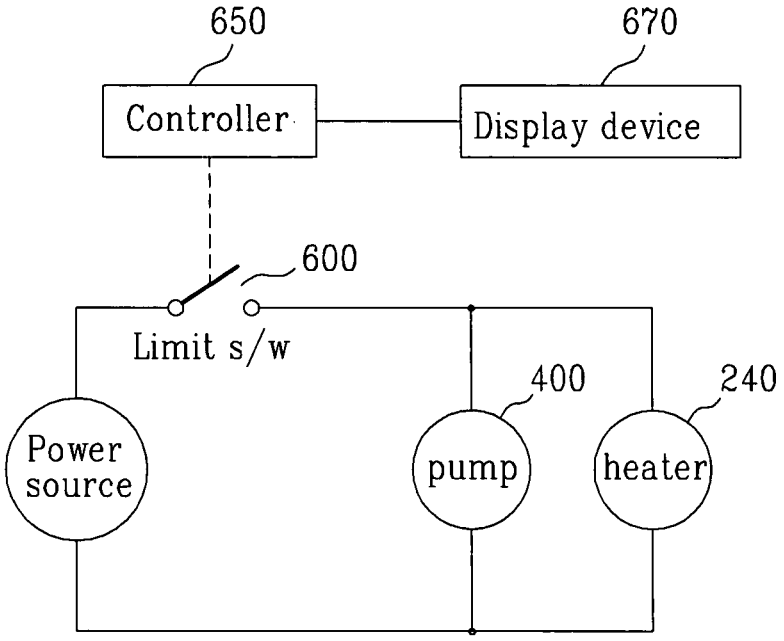
FIG. 7 is a block diagram illustrating switching unit to determine whether a water supply source is detached or not from a steam generator.

The switching unit 600 is comprised of the limit switch. As shown in FIG. 7, the limit switch 600 is connected between the steam generator 200 and the power source, preferably. In more detail, the pump 400 and the heater 240 are connected in parallel to the power source. That is, the limit switch 600 is connected between the power source and the pump 400/heater 240. Thus, the application of power for the pump 400 and the heater 240 is determined based on whether the limit switch 600 is turned-on/off.

Figure 8:
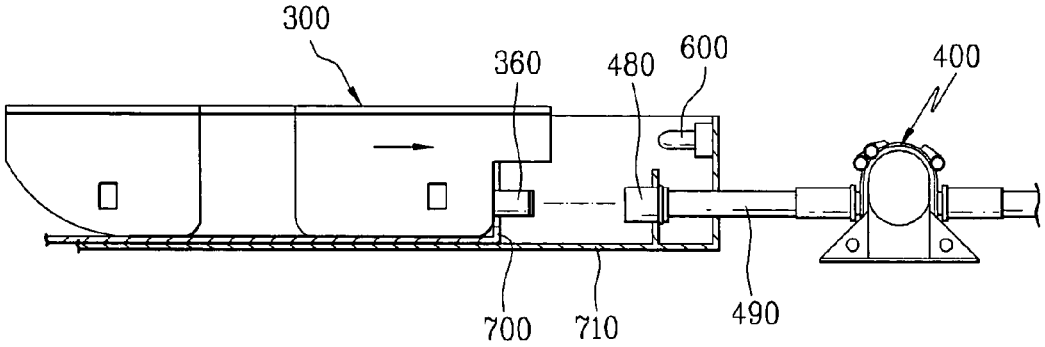
FIG. 8 is a lateral cross section view illustrating the state a water supply source is detached from a steam generator.

As shown in FIG. 8, a switch bar of the limit switch 600 is exposed to the surface of drawer guide 710 which is brought into contact with the drawer 700 when the drawer 700 is pushed in.

Figure 9:
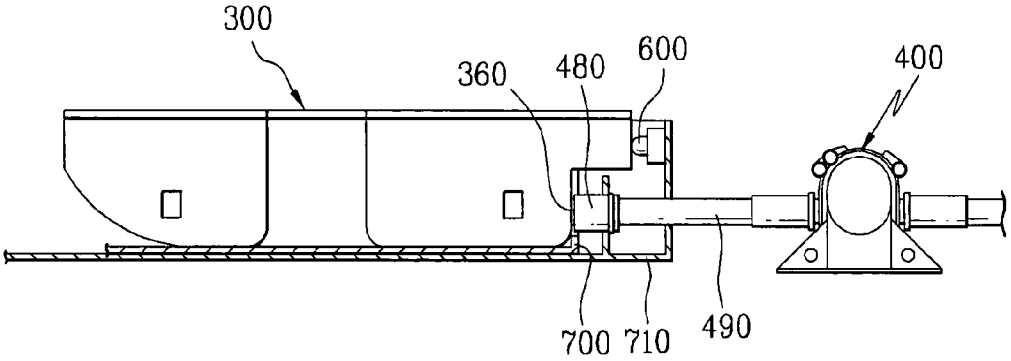
FIG. 9 is a lateral cross section view illustrating the state a water supply source is connected to a steam generator.

As shown in FIG. 9, the switch bar is installed at the rear side of drawer guide 710 such that the switch bar is pressed by the drawer 700 if the drawer 700 having the cartridge 300 mounted thereon is pushed in the drawer guide 710 maximumly, preferably.

Especially, at least one portion of the rear side of the drawer 700 has such an open shape as to allow the cartridge 300 mounted on the drawer 700 to be directly brought into contact with the switch bar when the drawer 700 having the cartridge 300 mounted thereon is pushed in, as shown in FIG. 9, preferably. It is preferable that one portion of the rear side of drawer 700 corresponding to the limit switch 600 be opened, so as to prevent the pressure to the switch bar even in case of that the drawer 700 on which cartridge 300 is mounted is incompletely pushed in or the drawer 700 on which cartridge 300 is not mounted is completely pushed in.

Accordingly, if the drawer 700 having the cartridge 300 mounted thereon is pushed in maximumly, the switch bar is pressed by the drawer 700. As a result, the limit switch 600 is turned on, so that the power is applied to the pump 400 and the heater 240. Meanwhile, if the cartridge 300 is not mounted on the drawer 700, the switch bar of limit switch 600 is not pressed so that the limit switch 600 is turned-off. As a result, the power is not applied to the pump 400 and the heater 240.

Then, controller 650 controls an entire system. That is, the controller 650 receives switching signals of the limit switch 600, and senses whether the cartridge 300 is mounted or not. The controller 650 uses the switching signals of the limit switch 600 as information necessary for the control of system. For example, display device 670 may be additionally provided to display whether the cartridge 300 is mounted or not to the user. Under control of the controller 650, the display device 670 may display whether the cartridge 300 is mounted or not, based on the switching signal of limit switch 600.

Figure 10:
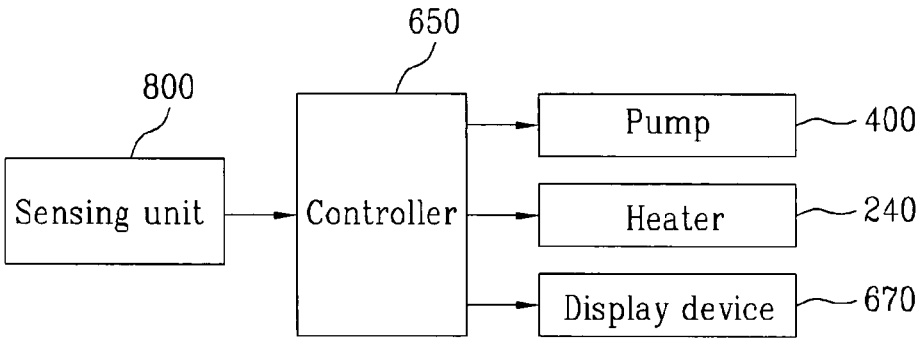
FIG. 10 is a block diagram illustrating sensing unit to determine whether a water supply source is detached or not from a steam generator.

As shown in FIG. 10, instead of the aforementioned switching unit 600, sensing unit 800 may be additionally provided to sense whether the cartridge 300 is mounted or not. Preferably, the sensing unit 800 is installed at the same position as the limit switch 700 employed as switching unit. The sensing unit 800 uses any one of photo-sensor and proximity-sensor. That is, when the drawer 700 is pushed in the drawer guide 710 maximumly, the sensing unit 800 can sense whether the cartridge 300 is mounted or not.

The controller 650 controls the driving of steam generator 200 by checking whether the cartridge 300 is mounted or not through the sensing unit 800. Also, the display device 670 may display whether the cartridge 300 is mounted or not.

If using the steam of high temperature according to the present invention, it permits the removal and prevention of wrinkles from the washed laundry. In addition, if the steam generator is provided with the detachable water supply source, the application of power to the steam generator is determined based on whether the water supply source is detached from the steam generator or not, thereby realizing the safety of product.

As mentioned above, the laundry dryer according to the present invention has following advantageous effects.

First, the laundry dryer according to the present invention has an effect of efficiently removing or preventing wrinkles from the dried laundry. In addition, the laundry may be sterilized and bad smell of the laundry may be removed.

Furthermore, the laundry dryer according to the present invention has another advantageous effect of providing the water supply source with reasonable price and simple structure. Especially, the application of power to the steam generator is determined based on whether the water supply source is detached from the steam generator or not, thereby realizing the safety of product and the reliability of product.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a cabinet;

a drum rotatably provided in a cabinet to receive laundry for washing or drying;

a steam generator configured to generate steam to be supplied to the drum, the steam generator including an electrical heater and provided in a predetermined portion of the cabinet;

a water supply source configured to:

be detachable from the laundry machine to selectively and fluidly communicate with the steam generator, and hold water to be supplied to the steam generator;

a water supply hose configured to supply water from the water supply source to the steam generator;

a pump to pump the water of the water supply source to the steam generator;

a steam hose configured to discharge steam from the steam generator to the drum;

a switch to switch electrically the heater and the pump off when the water supply source is detached or switch electrically the heater and the pump on to enable operations of the heater and the pump when the water supply source is attached, wherein the switch is connected between a power source and the steam generator and the switch is connected between the power source and the pump, the switch generating switching signal based on whether the water supply source is detached or not; and a controller to receive the switching signals and sense whether the water supply source is detached or not, the controller controls an operation of the laundry machine using the switching signals.

2. The laundry machine of claim 1, wherein the switch comprises a limit switch.

3. The laundry machine of claim 1, wherein the water supply source comprises:

a cartridge to store water therein; and a drawer, on which the cartridge is mounted, provided at the front of laundry machine.

4. The laundry machine of claim 3, wherein the switch comprises a limit switch which is turned on by the drawer when the drawer is fully pushed in.

5. The laundry machine of claim 1, further comprising a display to indicate that the water supply source is detached from the laundry machine when the water supply source is detached.

6. A laundry machine comprising:

a drum rotatably provided in a cabinet to receive laundry for washing or drying;

a steam generator, the steam generator including an electrical heater;

a water supply source configured to:

be detachable from the laundry machine, hold water to be supplied to the steam generator, the water supply source separately provided from the steam generator; and a sensor to sense whether the water supply source is detached or not;

a pump to pump the water of the water supply source to the steam generator; and a controller to control the heater off when the sensor senses that the water supply source is detached during operation of the heater, to control the pump off when the sensor senses that the water supply source is detached during operation of the pump, and to control the heater and the pump to be operated when the sensor senses that the water supply source is attached.

7. The laundry machine of claim 6, wherein the water supply source comprises:

a cartridge to store water therein; and a drawer, on which the cartridge is mounted, provided at the front of laundry machine to be pulled out or pushed in.

8. The laundry machine of claim 7, further comprising a drawer guide to guide the drawer to be pulled out or pushed in, wherein the sensor is mounted on the drawer guide and senses whether the drawer is fully pushed in.

9. The laundry dryer of claim 8, wherein the sensor comprises at least one of a photo-sensor and a proximity-sensor.

10. The laundry machine of claim 6, further comprising a display to indicate to a user whether the water supply source is detached or not.

11. A laundry machine comprising:

a cabinet;

a drum rotatably provided in a cabinet to receive laundry for washing or drying;

a water supply source configured to be detachable from the laundry machine, the water supply source holding water therein;

a steam generator to generate steam with water supplied from the water supply source, the steam generator including an electrical heater and provided in a predetermined portion of the cabinet separately from the water supply source;

a sensor to sense whether the water supply source is detached or not;

a pump to pump the water of the water supply source to the steam generator; and a controller to control the heater and the pump, wherein the controller controls the pump not to be operated when the sensor senses that the water supply source is detached or controls to be operated when the sensor senses the water supply source is attached, and wherein the controller controls the heater and the pump off when the sensor senses that the water supply source is detached or controls the heater and the pump on when the sensor senses that the water supply source is attached.

12. The laundry machine of claim 11, wherein the water supply source comprises:

a cartridge to store water therein; and a drawer, on which the cartridge is mounted, provided at the front of laundry machine to be pulled out or pushed in.

13. The laundry machine of claim 12, further comprising a drawer guide to guide the drawer to be pulled out or pushed in.

14. The laundry dryer of claim 11, further comprising a display to indicate to a user whether the water supply source is detached or not.

15. The laundry machine of claim 11, further comprising a switch configured to switch the heater of the steam generator off when the water supply source is detached or switch the heater on when the water supply source is attached.

16. The laundry machine of claim 15, wherein the switch the switch is connected between a power source and the steam generator.

* * * * *